United States Patent [19]

Burdet

[11] 4,320,484

[45] Mar. 16, 1982

[54] ELECTRO-OPTICAL ANALOG DIGITAL DISPLAY

[75] Inventor: Michel Burdet, Evilard, Switzerland

[73] Assignee: Societe Suisse pour l'Industrie Horlogere Management Services S.A., Bienne, Switzerland

[21] Appl. No.: 158,102

[22] Filed: Jun. 10, 1980

[30] Foreign Application Priority Data

Jun. 13, 1979 [CH] Switzerland ..... 5550/79

[51] Int. Cl.[3] ..... G04C 17/00

[52] U.S. Cl. ..... 368/239; 368/240; 368/71; 340/754

[58] Field of Search ..... 368/82–84, 368/239–242; 340/716, 754

[56] References Cited

U.S. PATENT DOCUMENTS 3,911,665 10/1975 Van Berkum ..... 368/29
3,938,134 2/1976 Hackstein et al. ..... 340/754
4,095,405 6/1978 Tanaka ..... 368/29

FOREIGN PATENT DOCUMENTS 52-35669 3/1977 Japan .
5432364 8/1977 Japan .

OTHER PUBLICATIONS

Patent Abstracts of Japan, vol. 1, No. 103, Sep. 13 1977, p. 3250 E77.
Patent Abstracts of Japan, vol. 3, No. 54, (E-109), May 10 1979, p. 53 E 109.

*Primary Examiner*—Vit W. Miska
*Attorney, Agent, or Firm*—Griffin, Branigan & Butler

[57] ABSTRACT

A simultaneous analog digital timepiece display comprises two superposed passive electro-optical cells one of which provides analog information and the other digital information. The timepiece is arranged and adapted such that the two types of information displayed are never directly superimposed. Such result is obtained through the provision of three zones for the digital display cell wherein one only of said zones is activated at any one time, such activated zone being chosen so as not to coincide with the position of the analog display hands.

6 Claims, 5 Drawing Figures

ELECTRO-OPTICAL ANALOG DIGITAL DISPLAY

BACKGROUND OF THE INVENTION

The present invention concerns an electro-optical passive timepiece display comprising a first display cell, a second display cell superposed on said first display cell and located in a different plane therefrom, said first cell comprising analog time indication means and said second cell comprising an alphanumeric or digital indicator.

A watch possessing a double superposed liquid crystal display cell is already known from the state of the art which shows in one position of a manual display control the hour, minute, second and date and in the other position of said control the display of the monthly calender. An examination of this timepiece shows that utilisation of liquid crystal display permits the obtaining of an information display density clearly greater than with a standard classical hands display. Continual efforts are being made to increase this density but often with the detriment of an unacceptable readibility. One may thus not reduce the dimensions of digits, signs or symbols below a certain lower limit, and in the same manner one may not squeeze together beyond a certain limit these digits or signs. Under such conditions one might considerably increase the display surface but this solution leads immediately to an excessive overall dimension.

U.S. Pat. No. 4,095,405 describes an LCD digital display of a single layer wherein the date indication is located in the center of the dial of the watch. In addition to the fact that such an arrangement necessitates the utilisation of hands of rather short length, thereby poorly reproducing the hands of the mechanical watch, it does not enable increasing the information density so as to be able to add to the watch a chronograph function showing tenths or even hundredths of a second for instance.

To overcome such difficulties it has already been proposed to provide a double layer display superposed as mentioned above. In one example thereof each LCD cell is enclosed in sandwich form between two very thin glass retainers, the units thereby obtained being fastened one under the other by means of an optical glue or another type of glue located outside the field of vision. In an other example each cell is placed on opposite sides of a glass layer, the unit thus formed being sandwiched between two further glasses. In the one example as in the other, each of the cells thus formed provides information which may be alternately displayed on the one or the other of the displays, through operation of the manual control for instance, or else simultaneously on both displays. If the information thus displayed is simultaneous, two cases may occur according to whether the information is superimposed or not. If a choice is made for an analog display of time information by electro-optical methods, and for the other display a digital indication of the date, there will obviously necessarily arise situations in which one type of information is concealed by the other information as would be the case for a mechanical watch or electro-mechanical watch. Thus, it is known in examples of realisation of the type of cells mentioned above that when two activated zones are superimposed result will be suppressed, this leading to non-excited zones and thereby rendering difficult the reading of the information.

SUMMARY OF THE INVENTION

The purpose of the present invention is to overcome such difficulties as mentioned above and to this effect proposes a double layer display arrangement which avoids such simultaneous superposition of the two excited zones.

The purpose is attained by means of the methods and dispositions as set forth in the claims.

DETAILED DESCRIPTION OF THE INVENTION

Figure 1:
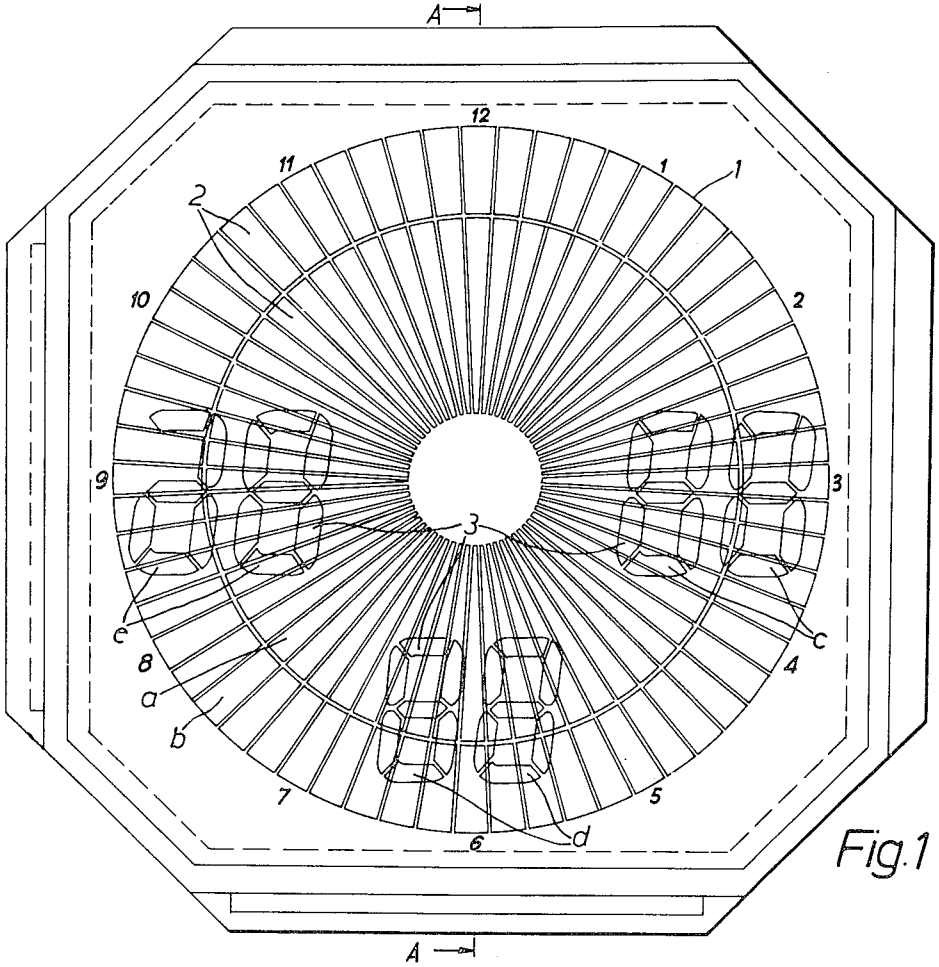
FIG. 1 is a plan view of the superposition of the two displays in accordance with the invention.

FIG. 1 shows the superposed arrangement of the two passive electro-optical displays. Facing the observer will be noted a first cell 1 arranged to indicate the time of day in the analog manner. Generally this comprises sixty enlongated rectilinear segments 2 juxtaposed and radially arranged around the dial of the watch. Each segment 2 provides two separated zones: the central zone and the zone b in the form of a crown surrounding zone a. The hours hand corresponds to the activation of one segment from zone a, the minutes hand to simultaneous activation of two radially corresponding segments from zones a and b taken together in their elongation and the seconds indication, if such exists, to an activation of a segment from zone b. A second cell 3 placed underneath the first is arranged to provide a digital or alphanumeric indication and comprises at least three displays zones, c, d and e which preferably may indicate the date. The invention however is not limited to the positioning of cell 3 under cell 1 and a reversed arrangement may equally be considered as falling within the invention.

Figure 2:
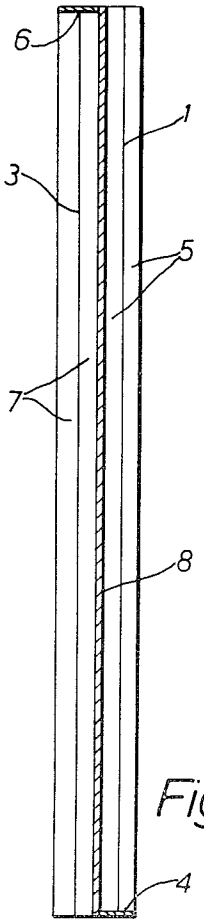
FIG. 2 is a cross section according to line A—A of FIG. 1.

FIG. 2 shows a section along line A—A of FIG. 1. It concerns one of the examples of realisation as already mentioned in the introduction. The first unit 4 comprises an electro-optical passive analog cell 1 arranged as a sandwich between two glass retainers 5 provided with control electrodes on the internal faces. The same arrangement prevails for the second unit 6 which is comprised of a digital cell 3 and two glass retainers 7. The units thus formed are fastened one over the other by means of an optical glue 8 or by means of another type of glue located outside the visual field.

As it is desired that simultaneous display of the time by cell 1 and the date by cell 3 be provided there will be necessarily superposition of the information if the date indicator comprises only a single zone for instance zone c as is generally the case in mechanical or electro-mechanical timepieces. The idea according to the invention is to provide the cell 3 indicating the date with at least 3 activable zones c, d and e and to activate only the zone which is not in any manner occulted by the hands indicating the time. As mentioned in the introduction one may thus avoid two superposed zones being activated at the same time which would gave as result a removal of the resulting information. Thus date indication is made to jump from one zone to the other in accordance with the position of the hands indicating the hour or the minute.

Electronic means not described but well known to the state of the art are employed to assure the functions to be carried out. A logic switching system comprises logic gates or transmission gates will erase two of the digital indicators as soon as occultation occurs and activate the third which is free from any possible superposition. As there may exist situations where there is no such superposition (hands at noon for instance) or the occultation of a single zone (hands at three fifteen for instance) the logic is arranged so that only one zone at a time may appear.

Figure 3:
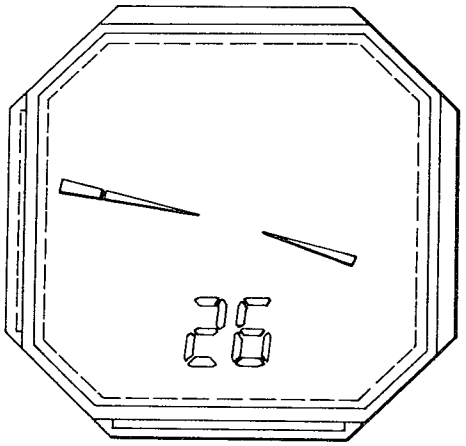
FIGS. 3, 4, 5 show three different situations for the display of the date according to the position of the time display all in accordance with the invention.

FIG. 3 shows a first situation where the date is displayed at 6 o'clock on the dial of the watch (zone d). In the example as shown it is the most frequent situation that such position is activated when the hours hand occupies any of the positions between 12 and 4 o'clock and between 8 and 12 o'clock and the minutes hand occupies any of the positions between 0 and 20 minutes and between 40 and 60 minutes.

Figure 4:
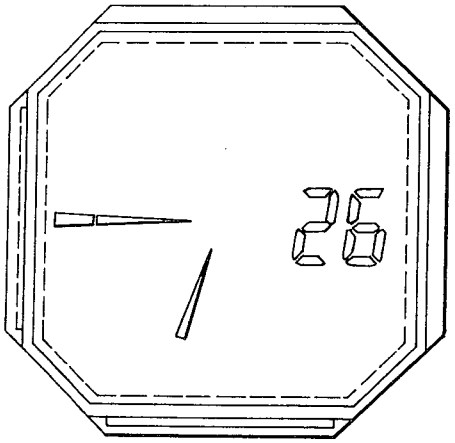

FIG. 4 shows a second situation where the date is displayed at three o'clock on the dial of the watch (zone c). If this situation which prevails whenever the minutes hand occupies positions from 20 to 40 minutes and the hours hand is situated between 8 and 12 o'clock. This same situation will prevail if the minutes hand is found between 31 and 60 minutes and if the hours hand occupies positions between 4 and 8 o'clock.

Figure 5:
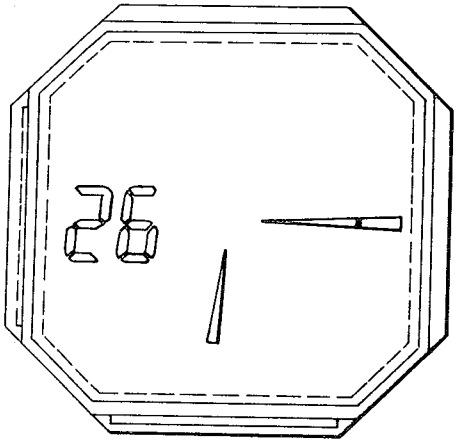

Finally FIG. 5 shows a third situation where the date is displayed at nine o'clock on the watch dial (zone e). It will occur each time that the minutes hand occupies the positions from 20 to 40 minutes and the hours hand is situated between 12 and 4 o'clock. This situation will also be present if the minutes hand is between 0 and 30 minutes and the hours hand between 4 and 8 o'clock.

Thus over an interval of 12 hours one will be provided with an indication of the date in three different positions. It will be appreciated that other choices may be made from those set forth in the three preceding paragraphs without departing from the purpose of the invention. It is evident that the system may also be applied to the representation of hours by a 24 hour dial.

As mentioned above relative to FIG. 1 zone b may provide an analog indications of seconds. Should one wish to avoid superposition of the seconds hand with the date indicator the digital zones may be brought closer to the dial center in a manner such that they are situated entirely within zone a. However it will be evident that a short duration superposition would be much less annoying since the seconds indication advances at a much greater speed. Accordingly the date digits can be left at the periphery of the dial.

It will be noted that the digital display thus described may at the same time provide a chronograph function. At the moment chosen the analog display of time may be suppressed and the three zones c, d and e are activated simultaneously. Supplementary digits may also be added to the digital cell, for instance a zone with two digits may be interposed between zones c and e which would permit increasing further the information density as described above.

What we claim is:

1. Electro-optical passive timepiece display comprising a first display cell, a second display cell superposed on said first display cell and located in a different plane therefrom, said first cell comprising analog time indicating means and said second cell comprising an alphanumeric or digital indicator, wherein said first and second cells are simultaneously excited, said second cell comprising at least three display zones one only thereof being activated, the zone thus activated being determined by the position of said analog time indicating means in a manner to avoid a superpositioning of the information being displayed.

2. Display as set forth in claim 1 wherein said second cell comprises a two digit numerical display in each of its three zones adapted to provide date information.

3. Display as set forth in claim 1 wherein said three display zones are situated respectively at 3 o'clock, 6 o'clock and nine o'clock on the timepiece dial.

4. Display as set forth in claim 3 wherein the zone at 3 o'clock is activated whenever the analog time indicating means is in either of the two conditions: hours hand from 4 o'clock to 8 o'clock with minutes hand from 31 to 60 minutes; or hours hand from 8 o'clock to 12 o'clock with minutes hand from 20 to 40 minutes.

5. Display as set forth in claim 3 wherein the zone at 6 o'clock is activated whenever the hours hand of the analog time indicating means occupies any of the positions between 12 o'clock and 4 o'clock or 8 o'clock and 12 o'clock and the minutes hand occupies any of the positions between 0 and 20 minutes or between 40 and 60 minutes.

6. Display as set forth in claim 3 wherein the zone at 9 o'clock is activated whenever the hours hand of the analog time indicating means is in either of the two conditions: hours hand from 12 o'clock to 4 o'clock with minutes hand from 20 to 40 minutes; or hours hand from 4 o'clock to 8 o'clock with minutes hand from 1 to 30 minutes.

* * * * *